US009535403B2

(12) United States Patent
Tschumi

(10) Patent No.: US 9,535,403 B2
(45) Date of Patent: Jan. 3, 2017

(54) DEVICE FOR SECURING A TIMEPIECE DIAL

(71) Applicant: The Swatch Group Management Services AG, Biel/Bienne (CH)

(72) Inventor: Philipp Tschumi, Niederwil (CH)

(73) Assignee: The Swatch Group Management Services AG, Biel/Bienne (CH)

( * ) Notice: Subject to any disclaimer, the term of this patent is extended or adjusted under 35 U.S.C. 154(b) by 0 days.

(21) Appl. No.: 14/546,164

(22) Filed: Nov. 18, 2014

(65) Prior Publication Data

US 2015/0212491 A1 Jul. 30, 2015

(30) Foreign Application Priority Data

Jan. 24, 2014 (EP) ..... 14152378

(51) Int. Cl.

| | |
|---|---|
| ***G04B 37/00*** | (2006.01) |
| ***G04B 29/00*** | (2006.01) |
| ***G04B 19/14*** | (2006.01) |
| ***G04D 3/04*** | (2006.01) |
| ***G04B 37/04*** | (2006.01) |
| ***G04B 29/04*** | (2006.01) |

(52) U.S. Cl.

CPC ..... *G04B 37/0008* (2013.01); *G04B 19/14* (2013.01); *G04B 29/04* (2013.01); *G04B 37/04* (2013.01); *G04D 3/04* (2013.01)

(58) Field of Classification Search

CPC ..... G04B 19/14; G04B 29/04; G04B 37/0008; G04B 37/04

USPC ..... 368/297–300, 314

See application file for complete search history.

(56) References Cited

U.S. PATENT DOCUMENTS 857,516 A 6/1907 Cunningham
892,147 A * 6/1908 Funk ..... G04B 37/05 368/299
2,641,901 A * 6/1953 Geoffrion ..... G04B 37/086 368/291

(Continued)

FOREIGN PATENT DOCUMENTS

EP 0 465 988 A1 1/1992
FR 1 038 556 9/1953

(Continued)

OTHER PUBLICATIONS

European Search Report issued Aug. 20, 2014, in European Application No. 14152378 filed Jan. 24, 2014 (with English Translation).

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A watch is delimited by a case formed of a back cover and of a middle part. A timepiece movement is disposed in a casing ring housed inside the watch case. The watch also includes a dial disposed on top of the casing ring and held by a fixing ring. The fixing ring has an S-shaped cross-section. An upper branch of the fixing ring is supported on the dial and a lower branch of the fixing ring is supported on the casing ring. The lower branch of the fixing ring is clamped between the middle part and the casing ring, so as to grip the dial between the upper branch of the fixing ring and the casing ring.

23 Claims, 1 Drawing Sheet

(56) References Cited

U.S. PATENT DOCUMENTS

| | | | | | |
|---|---|---|---|---|---|
| 3,817,025 | A * | 6/1974 | Siegrist | G04B 37/08 | 368/296 |
| 3,919,836 | A * | 11/1975 | Nishizawa | G04B 43/00 | 368/293 |
| 4,184,317 | A * | 1/1980 | Kanda | G04B 37/084 | 368/299 |
| 5,966,344 | A | 10/1999 | Umemoto et al. | | |
| 6,310,836 | B1 * | 10/2001 | Fujii | G04B 19/12 | 368/205 |
| 6,357,908 | B1 * | 3/2002 | Hunziker | G04B 37/05 | 368/299 |
| 6,406,178 | B1 * | 6/2002 | Luscher | G04B 37/0008 | 368/297 |
| 6,762,976 | B1 * | 7/2004 | Tamaru | G04B 37/005 | 368/300 |
| 2007/0097795 | A1 * | 5/2007 | Hosobuchi | G04B 19/247 | 368/37 |
| 2012/0236693 | A1 * | 9/2012 | Hiranuma | G04G 17/02 | 368/294 |

FOREIGN PATENT DOCUMENTS

| | | | | |
|---|---|---|---|---|
| FR | 1 107 415 | | 12/1955 | |
| GB | 1486059 | A * | 9/1977 | G04B 19/14 |
| JP | 51-112568 | | 9/1976 | |
| JP | 53-70252 | | 6/1978 | |
| JP | 54-109576 | | 8/1979 | |
| JP | 2003-43166 | | 2/2003 | |

* cited by examiner

DEVICE FOR SECURING A TIMEPIECE DIAL

This application claims priority from European Patent Application No. 14152378.7 filed on Jan. 24, 2014, the entire disclosure of which is hereby incorporated herein by reference.

FIELD OF THE INVENTION

The present invention concerns the field of timepieces and, more particularly, a device for securing a timepiece dial.

BACKGROUND OF THE INVENTION

It is known, in the field of watches, to use dials in the lower surface of which, i.e. on the movement side, are machined holes into which metal feet are driven. These metal feet serve, in particular, to hold the dials in place relative to the watch movement during assembly of the watch. This state of the art technique is disclosed, for example, in EP Patent No 0465988.

The making of such dials involves relatively complex machining operations, since the dials have to be pierced precisely several times before the metal feet are mounted. Further, the use of such dials in skeleton watches is unattractive.

Other devices for holding a watch dial exist and can at least partly overcome the aforementioned drawbacks.

U.S. Pat. No. 857,516, for example, discloses, in a particular embodiment, a polygonal-shaped mount into which the dial is forcibly inserted, under the effect of which the mount is deformed and the edges thereof hold the dial in place. The assembly formed by the dial and the mount is then disposed above the movement which includes a circular projecting wall for assembling the dial/mount assembly by snap fit.

This type of device for holding the dial on the watch movement is, however, unreliable over time. Indeed, the dial is held in place only by friction forces, so that shocks applied to the watch can cause a movement of the dial with respect to its reference position.

The device disclosed in U.S. Pat. No. 5,966,344 makes it possible to overcome this drawback. According to a first embodiment described in that patent document, a circular mount, fixed to the movement, includes, on the periphery thereof, recesses intended to receive, by force fit, corresponding portions of the dial. The force fit of the dial ensures that the latter cannot move, even as a result of shocks. However, this type of embodiment is unattractive in skeleton watches, since an opening can be seen between the dial and the mount. According to another embodiment disclosed by U.S. Pat. No. 5,966,344, the watch movement includes several holes arranged at the periphery thereof, the holes being intended to cooperate with feet integral with the dial. Such a device also involves complex machining operations, as the movement has to be pierced and the dial feet have to be made in one-piece with the dial.

SUMMARY OF THE INVENTION

It is an object of the invention to overcome the various drawbacks of the known prior art devices.

More specifically, it is an object of the invention to provide a device for fixing the dial to the movement which is simple to implement and which ensures that the dial is held securely.

It is also an object of the invention to provide a device for fixing the dial to the movement which is robust and inexpensive.

These objects, in addition to others, which will appear more clearly hereafter, are accomplished by the invention with the aid of a watch delimited by a case formed of a back cover and a middle part, a movement being disposed in a casing ring housed inside the watch case, the watch also including a dial disposed on top of the casing ring and held by means of a fixing ring.

According to the invention, the fixing ring has an S-shaped cross-section, an upper branch of the "S" being supported on the dial and a lower branch of the "S" being supported on the casing ring, the lower branch of the "S" being clamped between the middle part and the casing ring, so as to grip the dial between the upper branch of the "S" and the casing ring.

According to complementary characteristics of the invention, taken alone or in combination:

- the casing ring includes an outer peripheral shoulder on which the lower branch of the "S" is supported;
- the middle part includes a surface complementary to the outer peripheral shoulder of the casing ring, the lower branch of the "S" being clamped between the outer peripheral shoulder of the casing ring and the complementary surface of the middle part during assembly of the watch;
- the casing ring includes a peripheral rim on which the dial is supported;
- the middle part includes a peripheral groove in which the upper branch of the "S" is housed;
- means of positioning the dial on the casing ring are provided;
- the positioning means include a lug positioned on the casing ring and a notch arranged in the dial, the lug being housed in the notch so as to lock the radial position of the dial;
- the fixing ring is made in one-piece in a metallic material.

The invention also concerns a watch including a transparent or semi-transparent dial.

BRIEF DESCRIPTION OF THE DRAWINGS

Other features and advantages of the present invention will appear more clearly upon reading the following detailed description of an example embodiment of the invention, this example being given purely by way of non-limiting illustration with reference to the annexed drawing, in which.

DETAILED DESCRIPTION OF THE INVENTION

Figure 1:
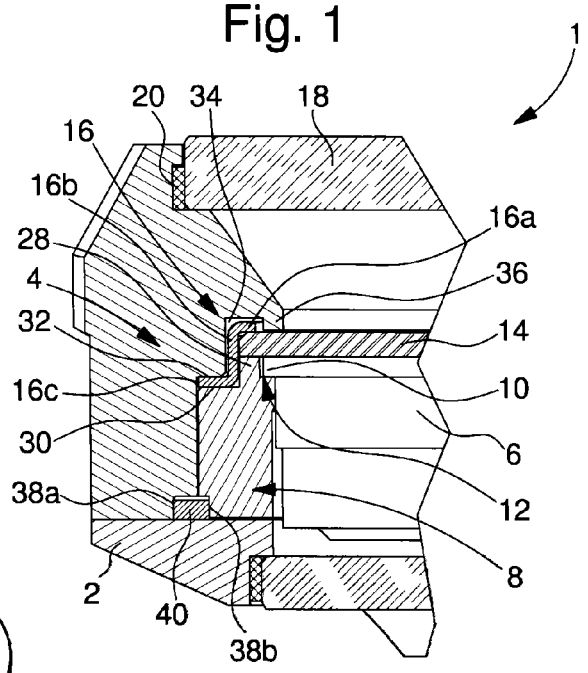
FIG. 1 is a cross-section of a watch including a device for fixing a dial according to the invention.

Designated as a whole by the general reference number 1, the watch case shown in FIG. 1 is delimited by a back cover 2 fixed by any appropriate means onto a middle part 4. A timepiece movement 6 is disposed in a casing ring 8 housed inside watch case 1. For the axial positioning thereof, timepiece movement 6 includes a collar 10 which is supported on an inner peripheral shoulder 12 of casing ring 8. The watch also includes a dial 14 disposed on top of casing ring 8 and held by means of a fixing ring 16 as described in more detail hereafter. Finally, watch case 1 is closed from above by a crystal 18 fixed to middle part 4 with the insertion of a sealing gasket 20.

A through orifice 22 pierced through casing ring 8 is intended to receive (see FIG. 2) a stem 24 of a time-setting crown 26, which simultaneously ensures the axial and radial positioning of timepiece movement 6 inside casing ring 8.

According to a characteristic of the invention, casing ring 8 is surmounted by a peripheral rim 28 on which dial 14 is supported. As can be seen in FIG. 1, fixing ring 16, formed, for example, of a metal part, has an S-shaped cross-section formed of an upper branch 16*a* and a lower branch 16*c* connected to each other by an intermediate branch 16*b*. The upper branch 16*a* of fixing ring 16 bears on all or part of the periphery of dial 14, whereas the lower branch 16*c* of the fixing ring 16 bears on casing ring 8. More specifically, casing ring 8 includes, in the median part thereof, an outer peripheral shoulder 30 on which the lower branch 16*c* of fixing ring 16 is supported. Finally, intermediate branch 16*b* of fixing ring 16 hugs the respective edges of casing ring 8 and dial 14, which permits the centering of dial 14 with respect to casing ring 8. The inner diameter of fixing ring 16 is made with a slight clearance with respect to the outer diameter of casing ring 8, so that fixing ring 16 can be fitted onto casing ring 8.

According to another characteristic of the invention, middle part 4 includes internally a surface 32 complementary to the outer peripheral shoulder 30 of casing ring 8, the lower branch 16*c* of fixing ring 16 being clamped between the outer peripheral shoulder 30 of casing ring 8 and complementary surface 32 of middle part 4 during assembly of the watch. Under the effect of this clamping, upper branch 16*a* of fixing ring 16 presses dial 14 against peripheral rim 28 of casing ring 8, ensuring that dial 14 is held perfectly. For this to be possible, the height of the intermediate branch 16*b* of fixing ring 16 is slightly smaller than the sum of the thicknesses of dial 14 and of peripheral rim 28 of casing ring 8.

It will be noted that middle part 4 includes internally a peripheral groove 34 which forms a recess which houses upper branch 16*a* of fixing ring 16 with some play and which is delimited by an outer edge 36 supported on dial 14. The width of peripheral groove 34 is slightly greater than that of upper branch 16*a* of fixing ring 16 so as to facilitate assembly. However, it must be ensured that the outer edge 36 of peripheral groove 34 is as thin as possible so as to maximise the visible surface of dial 14.

Two complementary circular grooves 38*a* and 38*b* are respectively arranged at the base of middle part 4 and of casing ring 8. When casing ring 8, which houses timepiece movement 6, is inserted into watch case 1, the joining of the two circular grooves 38*a* and 38*b* forms a groove in which a sealing gasket 40 is placed. When the back cover 2 is fixed, for example by screws, to middle part 4, sealing gasket 40 is compressed and deformed and exerts an upward vertical thrust force on casing ring 8. Under the effect of this thrust force, the outer peripheral shoulder 30 of casing ring 8 presses lower branch 16*c* of fixing ring 16 against complementary surface 32 of middle part 4. Under the effect of this clamping, upper branch 16*a* of fixing ring 16 presses dial 14 against peripheral rim 28 of casing ring 8.

During assembly of watch case 1, timepiece movement 6 is inserted from above into casing ring 8, after which dial 14 and fixing ring 16 are placed on top of casing ring 8. The resulting assembly is then slid from back cover 2 into the inner volume of watch case 1. Finally, back cover 2 is fixed to the middle part 4 of the watch.

Such an assembly thus allows dial 14 to be secured in a simple and effective manner without having to use dial feet.

Such an assembly is thus particularly advantageous for watches having a transparent or semi-transparent dial. Of course, this assembly can also be used with watches having an opaque dial.

Figure 2:
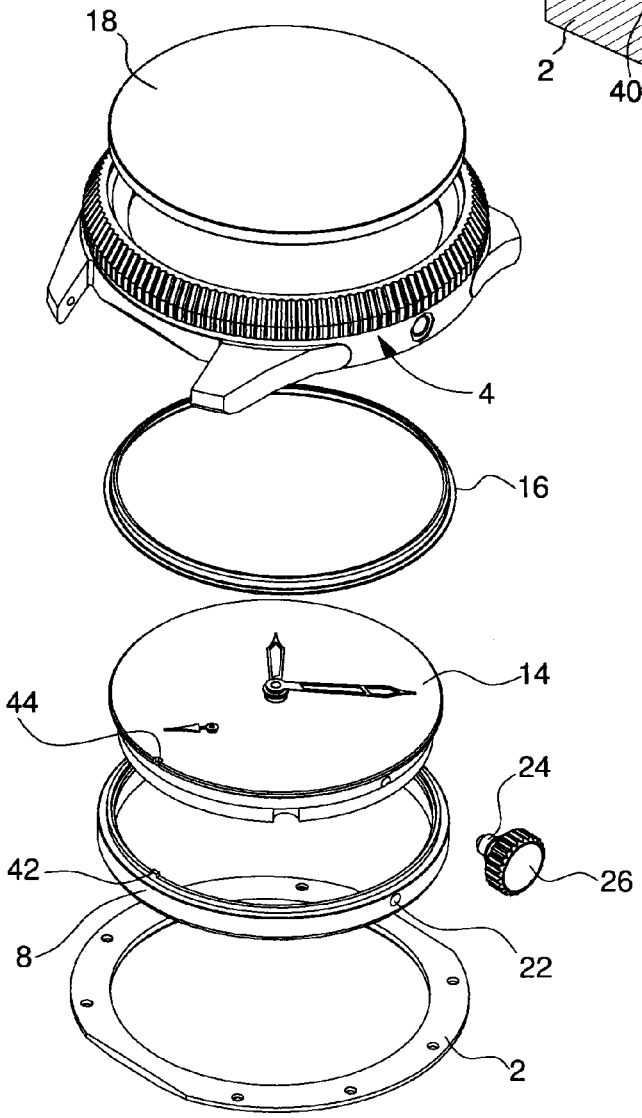
FIG. 2 is an exploded view of a watch receiving the device for holding the dial according to the invention.

According to a variant embodiment of the invention illustrated in FIG. 2, watch case 1 includes means for the radial positioning of dial 14 relative to casing ring 8. These positioning means may include, for example, a guide lug 42 positioned on casing ring 8 and a notch 42 arranged in dial 14, guide lug 40 being intended to penetrate notch 44 so as to ensure the angular positioning of dial 14. Of course, any other positioning means known to those skilled in the art may be suitable for positioning dial 14.

It goes without saying that this invention is not limited to the embodiment that has just been described and that various simple modifications and variants of the invention can be envisaged by those skilled in the art without departing from the scope of the invention as defined by the annexed claims. In particular, according to a variant (not shown in the drawing), casing ring 8 is provided at regularly spaced intervals along the base thereof with elastic strips which exert thereon an upward vertical elastic return force. Under the effect of this force, casing ring 8 clamps lower branch 16*c* of fixing ring 16 against middle part 4. Yet another mode of securing casing ring 8 consists in screwing the casing ring onto back cover 2 of watch case 1.

What is claimed is:

1. A watch comprising:

a watch case formed of a back cover and of a middle part;

a timepiece movement disposed in a casing ring housed inside the watch case;

a dial disposed in contact with a top face of the casing ring and held by a fixing ring, wherein the fixing ring has an S-shaped cross-section, wherein an upper branch of the fixing ring is supported on the dial, and a lower branch of the fixing ring is supported on the casing ring, and wherein the lower branch of the fixing ring is clamped between the middle part and the casing ring, so as to grip the dial between the upper branch of the fixing ring and the casing ring.

2. The watch according to claim 1, wherein the casing ring includes a peripheral rim on which the dial is supported.

3. The watch according to claim 2, wherein the upper branch and the lower branch of the fixing ring are connected to each other by an intermediate branch, wherein the height of the intermediate branch is lower than a sum of the thicknesses of the dial and of the peripheral rim of the casing ring.

4. The watch according to claim 3, wherein the casing ring includes an outer peripheral shoulder on which the lower branch of the fixing ring is supported.

5. The watch according to claim 4, wherein the middle part includes internally a surface complementary to the outer peripheral shoulder of the casing ring, wherein the lower branch of the fixing ring is clamped between the outer peripheral shoulder of the casing ring and the complementary surface of the middle part.

6. The watch according to claim 5, wherein the middle part includes internally a peripheral groove which forms a recess, wherein the recess houses the upper branch of the fixing ring with some play and, wherein the recess is delimited by an outer edge supported on the dial.

7. The watch according to claim 4, wherein the middle part includes internally a peripheral groove which forms a recess, wherein the recess houses the upper branch of the fixing ring with some play and, wherein the recess is delimited by an outer edge supported on the dial.

8. The watch according to claim 3, wherein the middle part includes internally a peripheral groove which forms a recess, wherein the recess houses the upper branch of the fixing ring with some play and, wherein the recess is delimited by an outer edge supported on the dial.

9. The watch according to claim 2, wherein the casing ring includes an outer peripheral shoulder on which the lower branch of the fixing ring is supported.

10. The watch according to claim 9, wherein the middle part includes internally a surface complementary to the outer peripheral shoulder of the casing ring, wherein the lower branch of the fixing ring is clamped between the outer peripheral shoulder of the casing ring and the complementary surface of the middle part.

11. The watch according to claim 10, wherein the middle part includes internally a peripheral groove which forms a recess, wherein the recess houses the upper branch of the fixing ring with some play and, wherein the recess is delimited by an outer edge supported on the dial.

12. The watch according to claim 9, wherein the middle part includes internally a peripheral groove which forms a recess, wherein the recess houses the upper branch of the fixing ring with some play and, wherein the recess is delimited by an outer edge supported on the dial.

13. The watch according to claim 2, wherein the middle part includes internally a peripheral groove which forms a recess, wherein the recess houses the upper branch of the fixing ring with some play and, wherein the recess is delimited by an outer edge supported on the dial.

14. The watch according to claim 1, wherein the casing ring includes an outer peripheral shoulder on which the lower branch of the fixing ring is supported.

15. The watch according to claim 14, wherein the middle part includes internally a surface complementary to the outer peripheral shoulder of the casing ring, wherein the lower branch of the fixing ring is clamped between the outer peripheral shoulder of the casing ring and the complementary surface of the middle part.

16. The watch according to claim 15, wherein the middle part includes internally a peripheral groove which forms a recess, wherein the recess houses the upper branch of the fixing ring with some play and, wherein the recess is delimited by an outer edge supported on the dial.

17. The watch according to claim 14, wherein the middle part includes internally a peripheral groove which forms a recess, wherein the recess houses the upper branch of the fixing ring with some play and, wherein the recess is delimited by an outer edge supported on the dial.

18. The watch according to claim 1, wherein the middle part includes internally a peripheral groove which forms a recess, wherein the recess houses the upper branch of the fixing ring with some play and, wherein the recess is delimited by an outer edge supported on the dial.

19. The watch according to claim 1, wherein two complementary circular grooves are arranged respectively at the base of the middle part and of the casing ring so that, when the casing ring, which houses the timepiece movement, is inserted into the watch case, the joining of the two circular grooves forms a groove in which a sealing gasket is placed.

20. The watch according to claim 1, wherein the watch comprises means of positioning the dial on the casing ring.

21. The watch according to claim 20, wherein the positioning means includes a guide lug positioned on the casing ring and a notch arranged in the dial, wherein the guide lug penetrates the notch so as to ensure the angular positioning of the dial.

22. The watch according to claim 1, wherein the fixing ring is made in one-piece in a metallic material.

23. The watch according to claim 1, wherein the dial is transparent or semi-transparent.

* * * * *